United States Patent [19]

Albarda

[11] 4,405,294

[45] Sep. 20, 1983

[54] DOSING PUMP

[75] Inventor: Scato Albarda, Gross Schenkenberg, Fed. Rep. of Germany

[73] Assignee: Drägerwerk AG, Fed. Rep. of Germany

[21] Appl. No.: 293,976

[22] Filed: Aug. 18, 1981

[30] Foreign Application Priority Data

Oct. 11, 1980 [DE] Fed. Rep. of Germany ..... 3038525

[51] Int. Cl.[3] ..... F04B 19/00; F04B 19/22

[52] U.S. Cl. ..... 417/488; 92/75

[58] Field of Search ..... 92/69, 70, 75; 417/460, 417/469, 487, 488

[56] References Cited

U.S. PATENT DOCUMENTS

| | | | |
|---|---|---|---|
| 1,274,884 | 8/1918 | Hudson | 92/69 |
| 2,971,466 | 2/1961 | Corbett | 417/488 |
| 3,302,578 | 2/1967 | Anderson | 417/488 |
| 3,464,359 | 9/1969 | King et al. | 417/488 |
| 3,586,129 | 6/1971 | Cass | 417/469 |
| 3,695,788 | 10/1972 | Loomans | 417/488 |

FOREIGN PATENT DOCUMENTS

| | | | |
|---|---|---|---|
| 802028 | 12/1950 | Fed. Rep. of Germany | 417/488 |

*Primary Examiner*—William L. Freeh

*Attorney, Agent, or Firm*—McGlew and Tuttle

[57] ABSTRACT

A valveless dosing pump is disclosed which comprises a housing having a cylindrical bore therein with a plurality of hard material rings press-fit into the bore and spaced from each other to leave annular inlet and outlet spaces. First and second pistons are slidably mounted within the rings and the housing is provided with inlet and outlet conduits communicating with the inlet and outlet spaces. The first piston is connected to a drive unit which moves the first piston through a complete stroke between the inlet and outlet spaces. The driving unit also abuts the second piston which moves through part of the stroke of the first piston and in the same direction. The difference between the strokes of the first and second pistons comprise a dosing volume. The rings are made of a suitable low friction dense and hard wear-resistant material, such as, silicon carbide or silicon nitride.

10 Claims, 8 Drawing Figures

DOSING PUMP

FIELD AND BACKGROUND OF THE INVENTION

The present invention relates to pumps in general and, in particular, to a new and useful valveless dosing pump which utilizes hard press-fit rings positioned within the bore of a housing defining inlet and outlet spaces therebetween with the rings receiving a first or relatively fixed piston and a second or swing piston.

In a volumetric feed apparatus, equal volumes of one or more liquid or gaseous secondary media are added in equal time intervals to a primary current, which may consist of solid, liquid and/or gaseous substances. The admixture can be effected continuously or intermittently. In the intermittent method, the secondary media must be divided into equal volumes, and the latter must be fed in equal or defined time intervals. The feeding can be effected either by varying the filling volumes or the time intervals from admixture to admixture.

In the continuous method, the secondary current is measured with known flow measuring methods and fed. In intermittent volumetric feedings, which are necessary for dosing small quantities, positive displacement pumps have proven to be most effective.

A known plunger pump is produced with piston diameters of 3 mm to 100 mm diameter, so that displacement volumes of several cc per hour to several cubic meter per hour are achieved. As a rule, the volume can be adjusted continuously even in a working pump, by varying the piston stroke. This is done by shifting the fulcrum of a tipping lever which transmits the movement from the driving motor over an eccentric shaft, which has already been transformed by an eccentric shaft into a reciprocating movement, to the piston. The fulcrum is shifted so that the piston always moves up to a dead front center, which is constant for all settings. This dosing pump thus has the same clearance volume over the entire piston stroke range. The accuracy of the dosing depends substantially on this clearance volume, that is, on the residual volume in the front dead center position of the piston, which is no longer delivered. When this residual volume is large, the compressibility of the dosing medium to be delivered enters into the output, particularly at higher pressures. The output thus depends on the backpressure. The greater the clearance volume is relative to the stroke volume, the less favorable is the output.

Another difficulty can be seen in the valves on the suction and pressure side of the stroke volume, thus, directly at the inlet and outlet socket of the dead center space. With excessive pressure in the dosing medium on the supply side, an uncontrolled flow of the dosing medium, independent of the piston movement, may appear on the pressure side, when the valve is opened (See Hengstenberg-Sturm-Winkler "Messen und Regeln in der chemischen Technik", Spring 1974, p. 407 to 408).

In another known dosing pump for liquids, namely, the Bosch injection pump, a piston with a constant stroke is used. The pump contains no suction valve, but only a pressure valve on the outlet side of the medium to be dosed. The adjustment of the displacement volume and, hence, of the dosing, is effected by socalled oblique edge control, which permits continuous adjustment by turning the piston, thus causing a part of the cylinder contents above the piston end face to flow back into the suction chamber.

This dosing pump works as follows: During the downstroke of the piston, the liquid to be dosed flows through lateral bores into the cylinder. During the upstroke, the delivery starts after opening the pressure valve to the outlet side, as soon as the piston covers the two lateral bores. Delivery takes place, however, only until the oblique control edge, which terminates a lateral recess in the piston wall and is connected over a groove with the end face, slides over one of the lateral bores. The pressure in the cylinder, that is, the pressure chamber, then collapses immediately, the pressure valve closes, and the dosing liquid, displaced by the further piston stroke, returns over the groove and the oblique control edge to the suction chamber. This pump also depends, for its absolute output, on the compressibility of the liquid to be delivered and the pressure generated there due to an unavoidable clearance volume. The pressure valve may only be open when the over-pressure opens the valve by the stroke of the piston. An elevated over-pressure in the flow medium can lead to an unintended flow from the suction pressure side (Hengstenberg-Sturm-Winkler "Messen und Regeln in der chemischen Technik", Springer 1964, 409–410).

A known valveless pump for delivering liquids has two pistons which are jointly guided in the bore of a cylinder. The two pistons are moved in the same direction in such a way that one piston regularly performs the full stroke movement, while the other piston only performs a part of the stroke by the driving mechanism, correspondingly pushed over a feed pipe. The difference in the stroke, together with the bore diameter of the cylinder, forms the displaced volume of the pump.

One piston is termed the fixed piston, and is secured, without axial play, on a slide which surrounds the cylinder in U-form, while the other piston acts as a swing piston over two collars at its end between which an axial stroke relative to the slide is possible. When the slide is moved back and forth, by a driver, in its longitudinal direction, the swing piston trails behind the movement of the slide and thus of the fixed piston connected with it, due to friction. It thus bears in one direction of motion on the end face of the fixed piston, while a cavity is formed between the end faces in the other direction of motion, which represents the displaced volume. The cavity is formed and disappears in the respective dead centers of the movement. The cylinders for the supply and discharge of the medium to be delivered are arranged there. By pushing a wedge between the inner collar of the swing piston and the slide to different levels, the axial stroke of the swing piston, and thus the delivery, can be reduced or stopped.

The pump provided for the delivery of liquids cannot be used for the delivery of gases. The friction between the cylinder and the piston will lead rapidly to wear and thus jeopardize the delivery. According to the invention, the materials used are very important. In addition, the braking of the motion of the swing piston, by gland-friction, is disadvantageous. The braking forces are not defined here, and they can be readily changed. The changes enter into the displaced volume (See German Patent No. 79,345).

SUMMARY OF THE INVENTION

The subject of the present invention is a dosing pump whose delivery, which is adjustable in a range of about 1 to 5 cu mm, is independent of the pressure in the dosing medium and has a stroke frequency of up to 20 Hz. The inventive pump does not permit the passage of the dosing medium to the pressure side, even with excess pressure on the suction side, and it permits the use of toxic, corroding and non-lubricating liquids as a dosing medium.

Accordingly, an object of the present invention is to provide a valveless dosing pump with two pistons, the suction and output pressure effect being produced by movement of the two pistons in the same cylindrical bore and in the same direction, the first one of the pistons being moved in a full stroke from an inlet to an outlet of the cylindrical bore while the second piston is controlled to perform a portion of the full stroke, the difference in travel of the two pistons comprising a stroke volume of the cylindrical bore. The pump includes a housing having an opening therein with a plurality of wear-resistant rings pressed into the opening and spaced from each other defining a plurality of gaps, one of the gaps forming an outlet space, another of the gaps forming an inlet space, and the housing having inlet and outlet bores communicating with said inlet and outlet spaces respectively. Another gap between rings receives a brake spring which engages a second piston to brake its motion.

The pump, according to the invention, is preferably designed so that the assembly of the hard elements of the cylinder necessary for wear resistance can be safely controlled. The connections for the supply and discharge of the media to be delivered are effected over the gaps between the rings. This results in maximum inlet and outlet openings, and thus minimum flow resistances. This contributes with gases to dosing accuracy (degree of filling). The brake spring, which is tangent to the swing pistons on both sides, ensures a constant braking action and thus a constant displaced volume.

This solution and the other features confirm the advantages of the dosing pump, according to the invention. They permit a compact and small design of the dosing pump, which can be easily examined. Variations of the stroke volume are readily possible. The use of the material sapphire, as well as other solid materials for the pistons and rings ensures maximum resistance to wear and a corresponding accurate fitting. The use of aluminum oxide ceramic as a material for the sleeve and the pipe of the control ensures the stroke volume by equal temperature expansion and, beyond that, prevents jamming of the sliding parts.

Another object of the invention is thus to provide a dosing pump which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
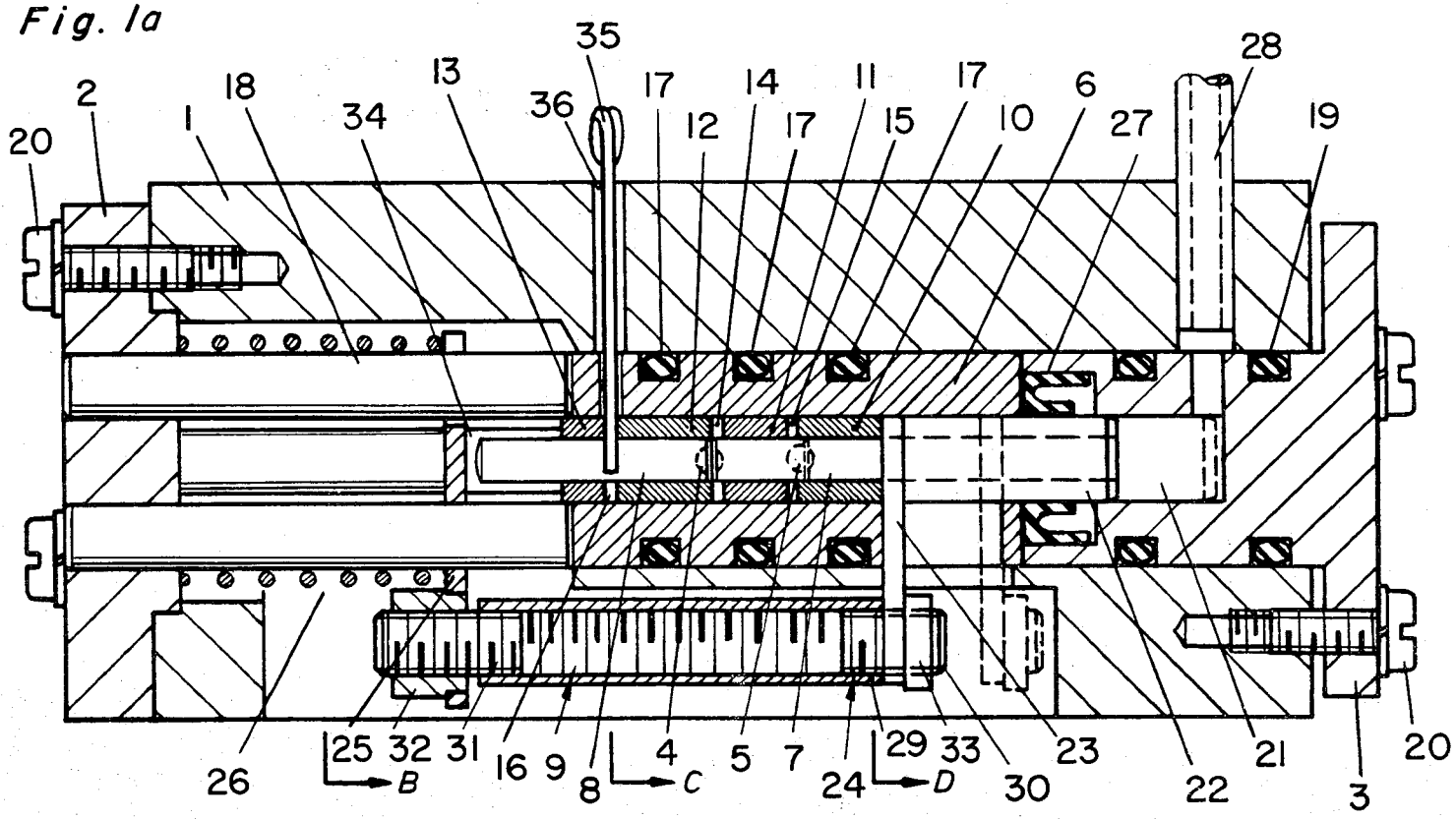
FIG. 1*a* is a side sectional view of a valveless dosing pump constructed in accordance with the present invention.
Figure 1D:
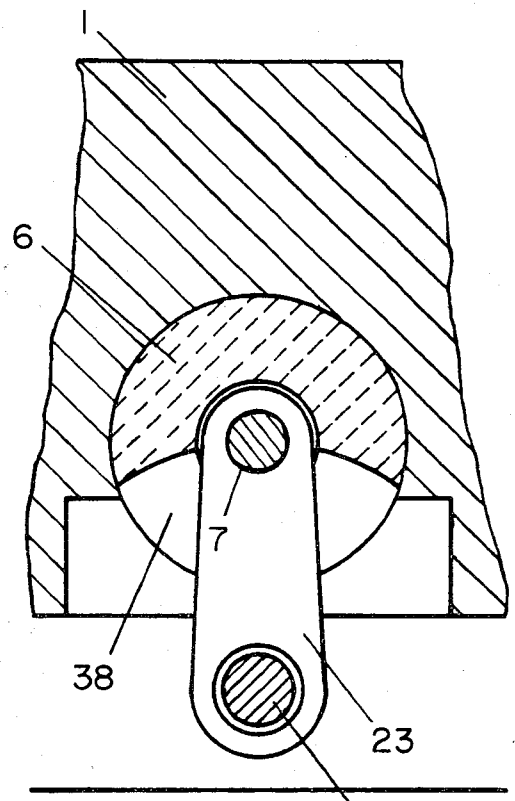
FIG. 1*d* is a sectional view taken along the line D of FIG. 1*a;*.
Figure 1C:
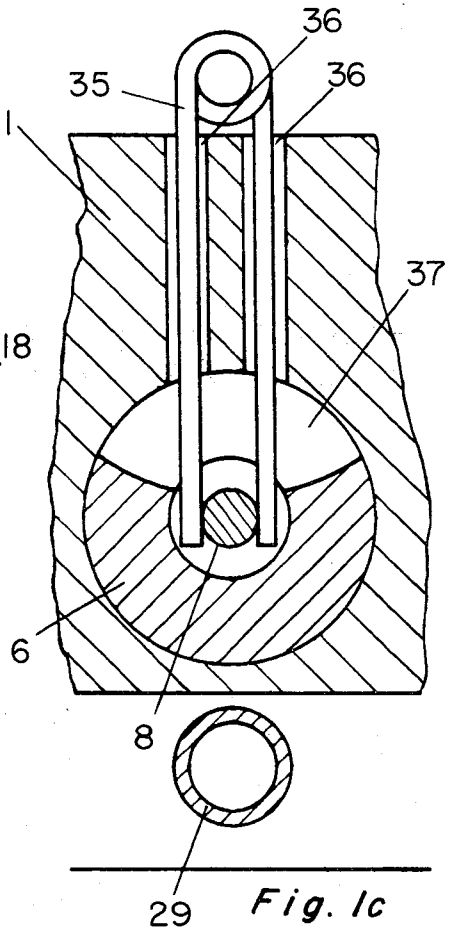
FIG. 1*c* is a sectional view taken along the line C of FIG. 1*a;*
Figure 1B:
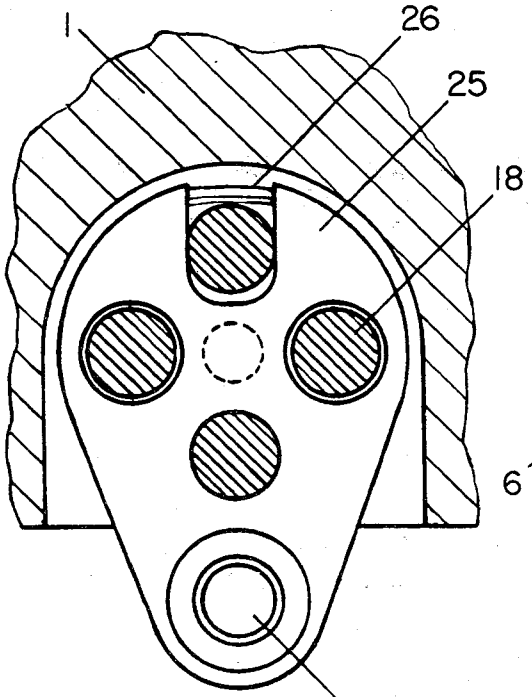
FIG. 1*b* is a sectional view taken along the line B of FIG. 1*a;*

Referring to the drawings in particular, the invention embodied therein in FIG. 1*a,* comprises, a valveless dosing pump having a casing 1 with a space or bore 21 therein which receives a plurality of wear-resistant rings that are press-fit into the bore and spaced from each other to define a plurality of annular gaps which have various purposes.

FIGS. 1*a* to 1*d* clearly show the design of the pump. The outer casing 1, closed by covers 2 and 3, contains the exactly mounted pump elements, as well as inlet bore 4 and outlet bore 5 for the medium to be dosed. The pump elements are the sleeve 6 with the piston guide, arranged axially in outer casing 1, the fixed piston 7, swing piston 8 and control 9.

Figure 2A:
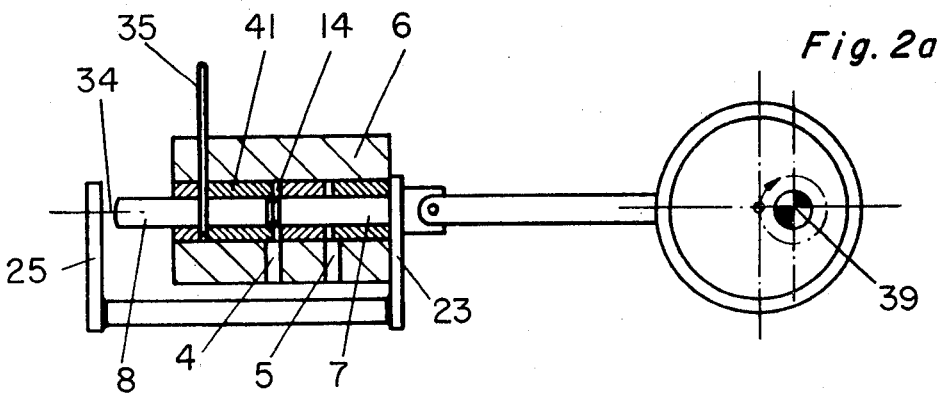
FIGS. 2*a* through 2*d* are sectional views of a simplified embodiment of the invention shown in four consecutive positions during its operation.
Figure 2B:
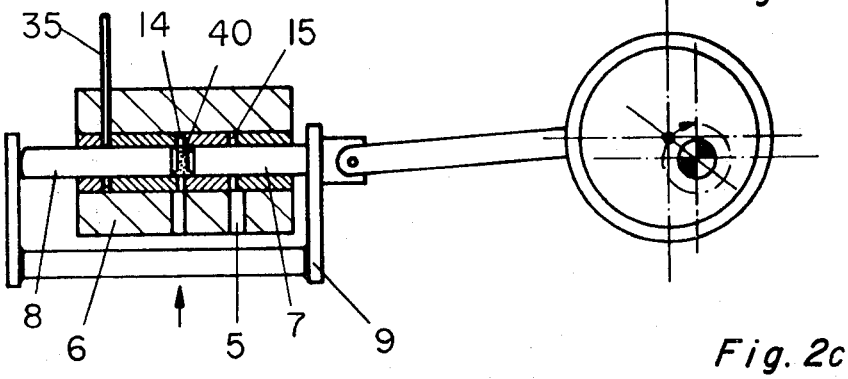
Figure 2C:
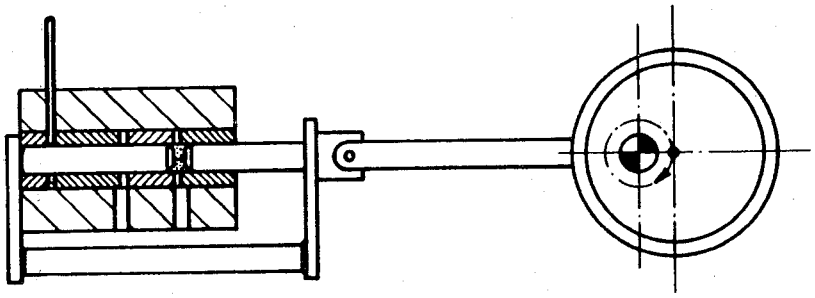
Figure 2D:
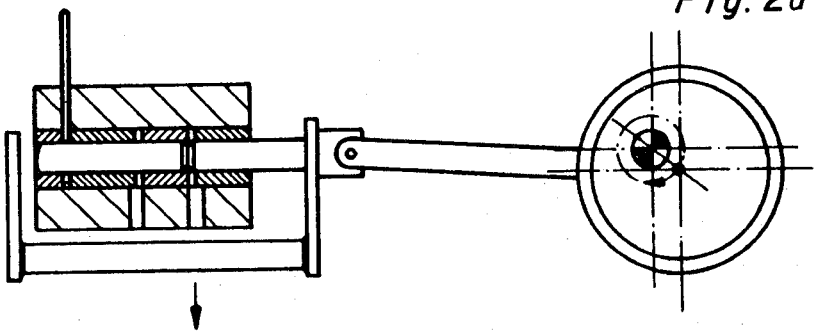

Sleeve 6 contains, as a guide 41 for fixed piston 7 and swing piston 8 (see FIGS. 2*a* and 1*a*), the pressed-in rings 10, 11, 12 and 13. Rings 10 to 13 are made of a wear-resistant material, such as sapphire, silicon carbide or silicon nitride. Gaps 14, 15 and 16 are provided between the rings. Gap 14 is opposite inlet bore 4 and gap 15 is opposite the outlet bore 5. They are joined with the gaps. Gap 14 thus serves for the supply of the dosing medium, and gap 15 serves for its discharge. Sleeve 6 is sealed from outer casing 1 by gaskets 17. The axial position is determined by pins 18 in cover 2. It is secured by cover 3 sealed over gaskets 19. Both covers are held by screws 20. Rings 10, 11, 12 and 13 have a common bore in which the two exactly fitting sapphire pistons, the fixed piston 7 and the swing piston 8, slide (clearance about 2 to 10 u mm with a diameter of 2 mm).

The movement of the pistons is effected over control 9. Fixed piston 7, together with tongue 23 and sleeve 22, which slides in sleeve bore 21, is joined with the fixed piston 7. Tongue 23 is a part of control 9, with which a resilient support relative to cover 2 is achieved over stroke regulator 24, stop plate 25 and coil spring 26. Sleeve 22 is sealed from sleeve bore 21 over packing 27. Sleeve bore 21 is connected over line 28 with a pressurized driving source for moving control 9. The driving source, in this embodiment, is a gas pressure varying with the stroke frequency.

The length of the stroke for the pistons can be adjusted over stroke regulator 24. To this end, it consists of a pipe 29 with threaded plugs 30 and 31. Together with plug 31, pipe 29 is screwed into nut 32 of stop plate 25 and, with the other plug 30, it is placed into tongue 23 and locked there with nut 33. The clearance 34 between swing piston 8 bearing on fixed piston 7 and stop plate 25 thus determines the dosing. Exact variation of clearance 34 is possible in a simple manner by loosening nut 33 and turning pipe 29 in nut 32. Sleeve 6 and pipe 29 may be made of aluminum oxide ceramic.

Other means for varying the stroke length are possible, for example, a pipe 29 can be fixed between stop plate 25 and tongue 23. Fixed piston 7 is then held at different levels in tongue 23 over spacers of different thickness.

Swing piston 8 is under the braking action of brake spring 35 which is pushed into gap 16, touching it on both sides. Braking spring 35 is introduced into outer casing 1 through bore 36. The introduction into gap 16 is simplified by recess 37 in sleeve 6. Recess 38 on the underside of sleeve 6 and of outer casing 1 permits the stroke movement of tongue 23.

The operation of the dosing pump is shown in FIGS. *2a* to *2d*. The drive is effected here over a crank drive. The pressure drive with air or a gas according to FIG. *1a* or an electromagnetic drive hardly change anything in control 9. The axis of rotation of the drive of the eccenter is designated 39.

FIG. *2a* shows the left dead center. Swing piston 8 bears with its right end face on the left end face of fixed piston 7. Clearance volume in front of gap 14, and thus in front of inlet bore 4, is practically zero.

With the rotation of the drive, control 9 is pulled to the right. It entrains fixed piston 7, according to FIG. *2b*, while swing piston 8, held by brake spring 35, remains in its position in sleeve 6, only space 34 is filled up. With the movement of fixed piston 7 to the right, suction zone 40 is formed corresponding to the set dose and is filled with the dosing medium.

With continued rotation of the eccenter to the right dead center corresponding to FIG. *2c*, both pistons, maintaining the filled suction zone 40, are pulled with the latter to gap 14 and thus to outlet bore 5.

With the further rotation between FIGS. *2c* and *2d*, while swing piston 8 stands still under the action of brake spring 35, the dosing medium is forced out over gap 15 and outlet bore 5.

With clearance volume at zero, suction chamber 40 has filled up again, with the piston end faces bearing on each other, and control 9 presses the two pistons again into the dead center with the piston position according to FIG. *2a*.

While specific embodiments of the invention have been shown and described in detail to illustrate the application of the principles of the invention, it will be understood that the invention may be embodied otherwise without departing from such principles.

What is claimed is:

1. A pump, comprising:

a housing having a bore therein;

a plurality of wear-resistant rings pressed into said housing bore and spaced from each other defining a common piston bore;

a first piston slidable in said common piston bore;

a second piston slidable in said common piston bore next to said first piston;

said housing having means defining an inlet and outlet communicating with said housing bore, said plurality of rings spaced from each other to form an inlet space communicating with said inlet and an outlet space communicating with said outlet;

control means connected to said first piston for moving said first piston through a pumping stroke from said inlet space to the vicinity of said outlet space, said control means engaging with said second piston to move said second piston in the same direction as movement of said first piston through a portion of said stroke, a maximum clearance between said first and second pistons in said piston bore comprising a stroke volume;

two of said plurality of wear-resistant rings define one additional space; and a brake spring extending through said one additional space and engaging said second piston for braking the movement of said second piston.

2. A pump, according to claim 1, wherein four wear-resistant rings are pressed and provided in said housing bore defining three gaps forming said inlet space, said outlet space and said one additional space for receiving said brake spring.

3. A pump, according to claim 2, wherein said rings are made of a material chosen from the group consisting of sapphire, silicon carbide and silicon nitride.

4. A pump, according to claim 3, wherein said first and second pistons are made of a material chosen from the group consisting of sapphire, silicon carbide and silicon nitride.

5. A pump, according to claim 1, wherein said control means comprises a tongue connected to said first piston, a pipe member connected to said tongue and a stop plate connected to said pipe member and engageable with said second piston to move said second piston.

6. A pump, according to claim 5, including stroke volume adjustment means connected between said pipe member and at least one of said tongue and stop plate for adjusting the spacing between said tongue and said stop plate.

7. A pump, according to claim 5, including adjustable spacer means connected between said first piston and said tongue for adjusting the spacing between said first piston and said stop plate.

8. A pump, according to claim 5, including elastic damping elements on surfaces of said tongue and stop plate for dampening movement of said control means, said surfaces of said tongue and stop plate being opposite a sleeve within said housing positioned between said housing bore and said rings for receiving said rings.

9. A pump, according to claim 8, wherein said sleeve and said pipe member are made of aluminum oxide ceramic.

10. A pump, comprising:

a housing having a bore therein;

a plurality of wear-resistant rings pressed into said housing bore and spaced from each other defining a common piston bore;

a first piston slidable in said common piston bore;

a second piston slidable in said common piston bore next to said first piston;

said housing having means defining an inlet and outlet communicating with said housing bore, said plurality of rings spaced from each other to form an inlet space communicating with said inlet and an outlet space communicating with said outlet;

control means connected to said first piston for moving said first piston through a pumping stroke from said inlet space to the vicinity of said outlet space, said control means engaging with said second piston to move said second piston in the same direction as movement of said first piston through a portion of said stroke, a maximum clearance between said first and second pistons in said piston bore comprising a stroke volume;

said pump including four wear-resistant rings spaced from each other in said housing bore to define three gaps, two of said gaps comprising said inlet space and said outlet space and the remaining one of said gaps provided for receiving a brake spring;

said brake spring having two legs straddling and engaging opposite sides of said second piston for braking motion of said second piston;

said control means comprising a tongue connected to said first piston and extending laterally of said piston bore, a pipe member connected to said tongue, a stop plate connected to said pipe member and threadable therewith to adjust the distance between said stop plate and tongue, said stop plate extending radially toward said bore for engagement with said second piston;

a return spring between said stop plate and a portion of said housing for return motion of said control means; and a driver associated with said control means for moving said control means through said stroke.

* * * * *